US006119965A

United States Patent [19]

Chang

[11] Patent Number: 6,119,965

[45] Date of Patent: Sep. 19, 2000

[54] HOLLOW-CORE NOZZLE

[76] Inventor: Sei-Chang Chang, 2F, No.3, Aly.10, Ln.304, An Leh Rd., YungHo City, Taipei Hsien, Taiwan

[21] Appl. No.: 09/240,795

[22] Filed: Jan. 30, 1999

[51] Int. Cl.[7] ..... B05B 1/34

[52] U.S. Cl. ..... 239/467; 239/500; 239/498

[58] Field of Search ..... 239/380, 382, 239/461, 464, 466, 467, 488, 493, 468, 497, 469, 589, 500, 501, 498

[56] References Cited

U.S. PATENT DOCUMENTS

| | | | |
|---|---|---|---|
| 501,178 | 7/1893 | Bourdil | 239/468 |
| 569,243 | 10/1896 | Sholder | 239/468 |
| 2,763,514 | 9/1956 | Hansen et al. | 239/501 |
| 3,321,141 | 5/1967 | Gemeny | 239/501 |
| 4,176,794 | 12/1979 | Allenbaugh, Jr. | 239/498 |
| 4,717,076 | 1/1988 | Notkin | 239/467 |

*Primary Examiner*—Andres Kashnikow
*Assistant Examiner*—Jorge Bocanegra
*Attorney, Agent, or Firm*—W. Wayne Liauh

[57] ABSTRACT

A hollow-core nozzle structure which can provide solid core beam typically generated by a solid-core nozzle. The hollow-core nozzle structure contains (1) a hollow passage which is in communication with a water inlet connected sideways to the hollow passage; (2) a water outlet at an end of the hollow passage; (3) a bell-shaped stream-guide plate furnished on an outer rim of the water outlet. The stream-guide plate is provided with, in the order away from the outer rim, a plurality of first, second, and third water baffles respectively arranged in a circular manner. The first water baffles are rectangular in shape, the second water baffles are also rectangular shape but with a bevel on one thereof facing inward, and the third water baffles are triangular in shape, so as to cause a portion of sprayed water to be broken into tiny drops which exit the stream-guide plate along a central line and an outer rim of a water beam to form a solid water beam.

1 Claim, 4 Drawing Sheets

HOLLOW-CORE NOZZLE

BACKGROUND OF THE INVENTION

1. Field of the Invention

This invention relates to a tangential type hollow core nozzle, which can evenly spray out a solid-core water beam so as to provide a better atomization.

2. Description of the Prior Art

Conventional nozzles may be sorted in three kinds, i.e., a sector type, a solid-core type and a hollow-core type. Since the sector type of nozzle has no relation with the present invention, no further details are given. The conventional tangential type of hollow-core nozzle 10 has a hollow core as shown in FIG. 4, which has a horizontal eccentric water inlet 11. As soon as water flows into the hollow core through the water inlet, the water in the nozzle 10 will flow forwards along the tangent to hit the inner surface of the nozzle 10 continuously and quickly, causing the water beam to be sprayed out of the water outlet 12 in the round of a cylindrical and hollow beam.

The solid-core nozzle 20 has a spoiling core 21 in the center of a spiral structure 23. As shown in FIG. 5, water flowing into the nozzle 20 from the water inlet 22 will change its direction as a result of the spoiling core 21 of the spiral structure 23, i.e., water will flow quickly and spirally in the nozzle 20 before it is being sprayed out of the water outlet 24 of the nozzle 20. The water beam sprayed out of the water outlet 24 is a solid core beam.

The aforesaid two conventional nozzles 10 and 20 each have their usage, advantages and drawbacks. With respect to usage, the two nozzles 10 and 20 are further described in accordance with their merits and demerits as follows:

1. Operation pressure:

Since the solid-core nozzle 20 with a spoiling core 21 has a smaller water-passage caliber, it would cause a higher pressure loss. Therefore, it needs a higher water pressure for maintaining the normal operation. The hollow-core nozzle 10 does not require a very high pressure for operation, and it can operate normally under a lower water pressure relatively.

2. Water (or other liquids) particles:

Water sprayed out of the hollow-core nozzle 10 will flow through the tangential inner surface of the nozzle 10 to form into a strong and spiral stream so as to have the water drops broken easily into tiny particles, resulting in a better atomization. In the solid-core nozzle 20, the spoiling core 21 therein is directly hit with water to change the flowing direction of water, thus resulting in a higher pressure loss. As a result, its capability of breaking water drops will be reduced, and the water particles in the water beam are much bigger, i.e., having a poor atomization.

3. Scattering a water sprayed:

The hollow-core nozzle 10 sprays a ring-shaped hollow beam, and its effectiveness under certain conditions is limited. The solid-core nozzle 20 will spray a solid beam, which can be used widely.

4. Blockade possibility:

Since the solid-core nozzle 20 is furnished with a spoiling core 21, some miscellaneous matters might be gathered in the small water passage of the nozzle to cause a blockade. The hollow-core nozzle 10 will not suffer from such blockade.

SUMMARY OF THE INVENTION

In view of the respective shortcomings of the aforesaid two conventional nozzles, the applicant has developed a "hollow-core nozzle," which enables a tangential hollow-core nozzle to spray a solid-core water beam with improved atomization.

The hollow-core nozzle according to the present invention has a feature of providing a larger stream-guide area on the water outlet, and the stream-guide plate thereof is furnished with a plurality of water baffles (having two or more than two rows of water baffles) so as to break the water drops that are being sprayed out by the nozzle, by means of a centrifugal effect provided in the outlet, into smaller particles as a result of rebounding therefrom, and then a better atomization can be provided. The water particles will exit evenly in the center and along the outer periphery of the water beam. In other words, a solid-core water beam can be sprayed out using a hollow core nozzle. The structure and effectiveness of the present invention is further described by means of an embodiment accompanied with several drawings.

DETAILED DESCRIPTION OF THE PERFERRED EMBODIMENT

Figure 1:
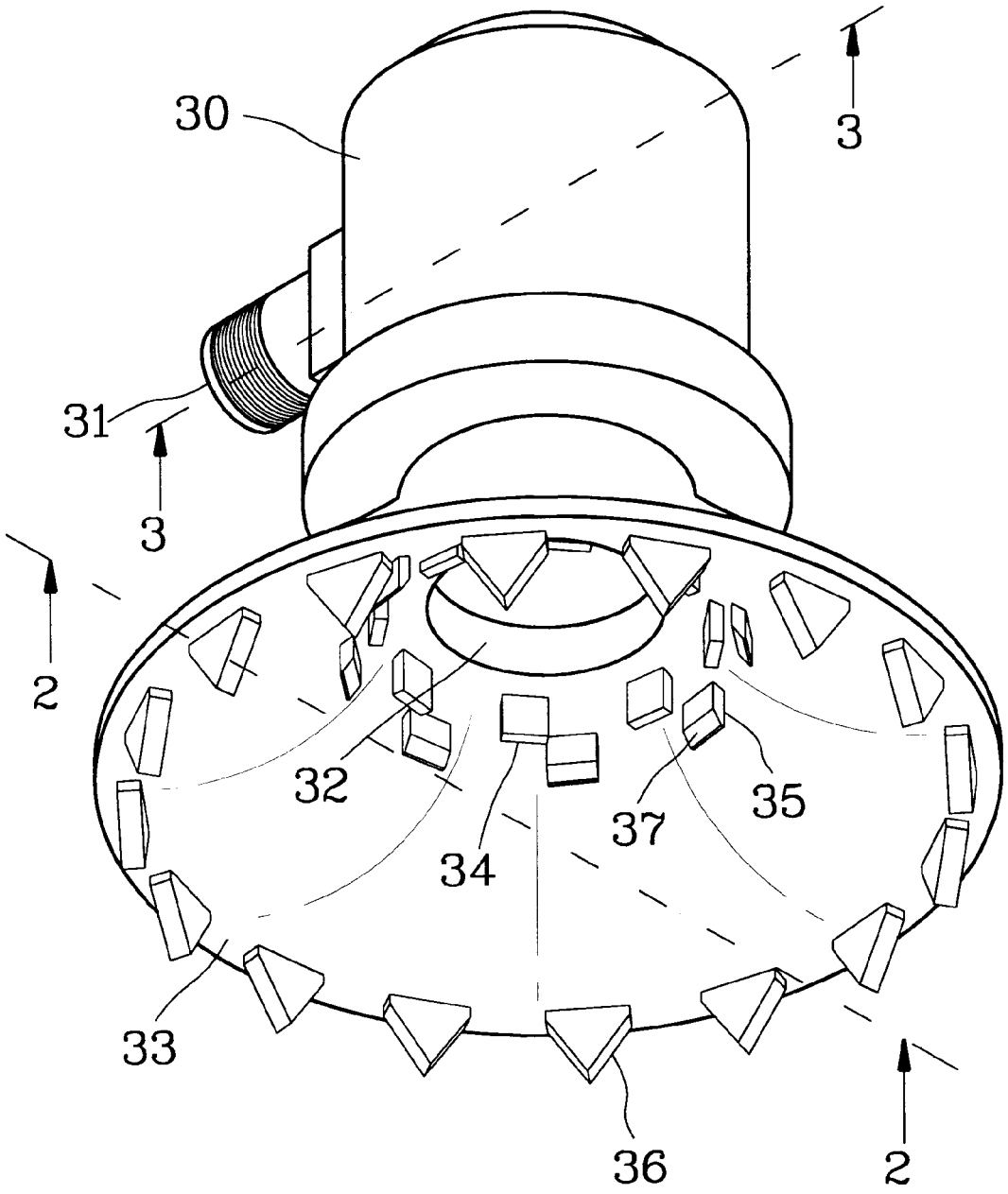
FIG. 1 is a perspective view of an embodiment according to the present invention.
Figure 2:
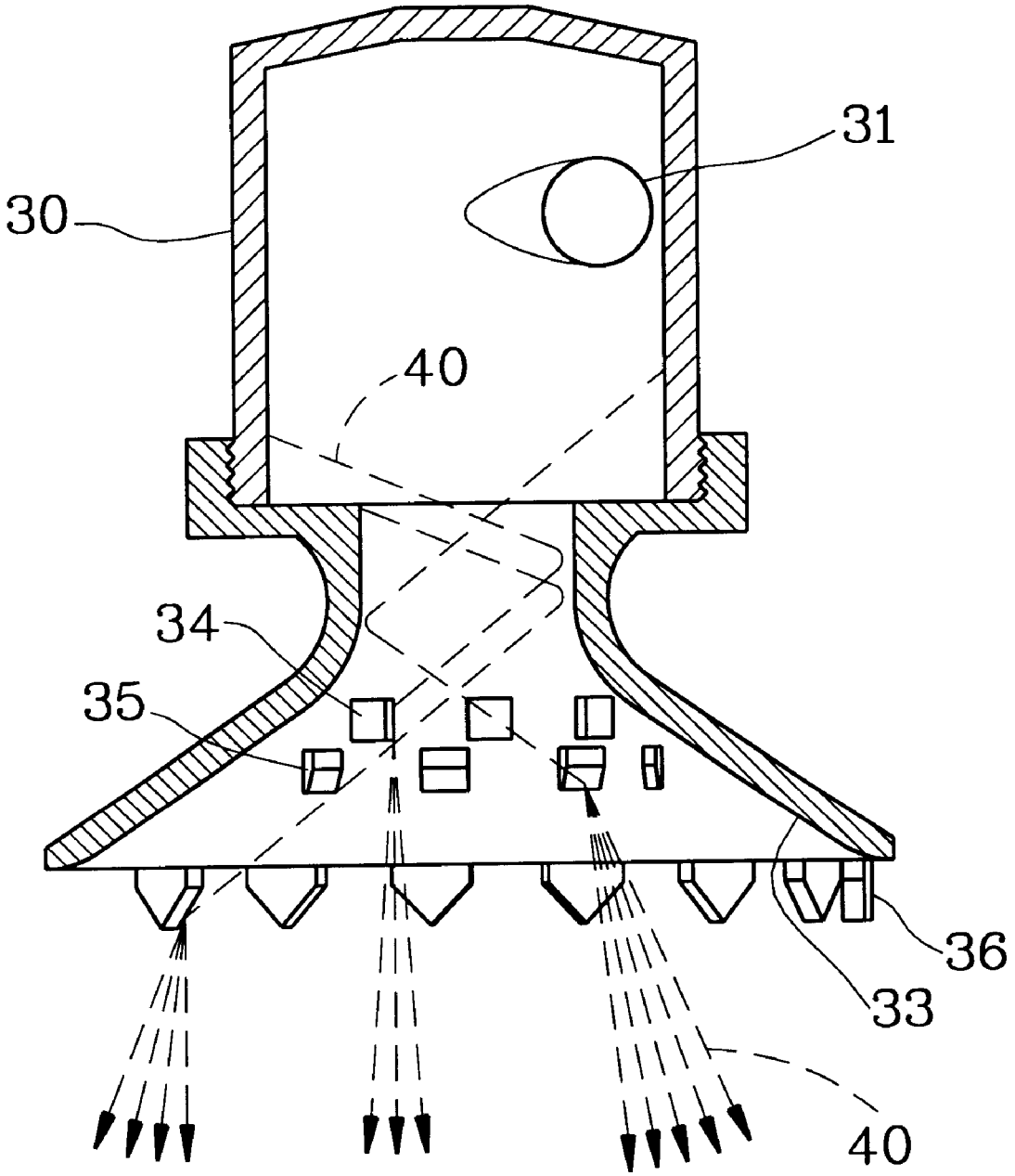
FIG. 2 is a sectional view of the present invention taken along line 2—2 as shown in FIG. 1.
Figure 3:
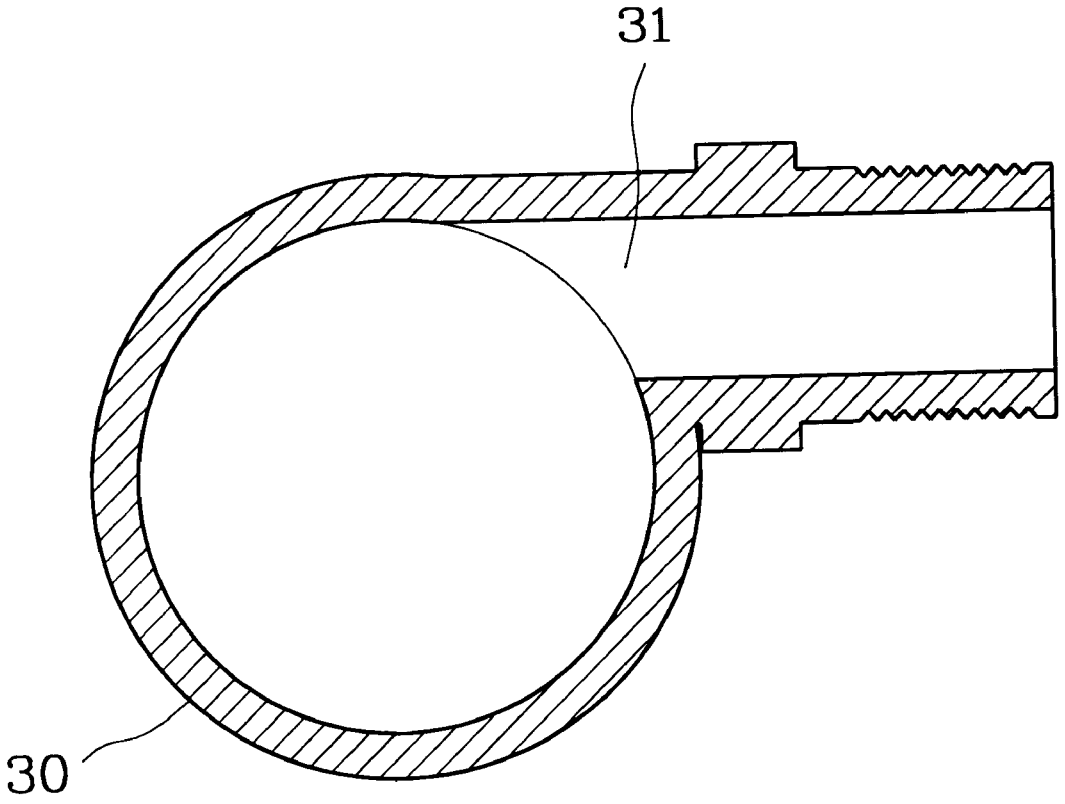
FIG. 3 is a sectional view of the present invention taken along line 3—3 as shown in FIG. 1.
Figure 4:
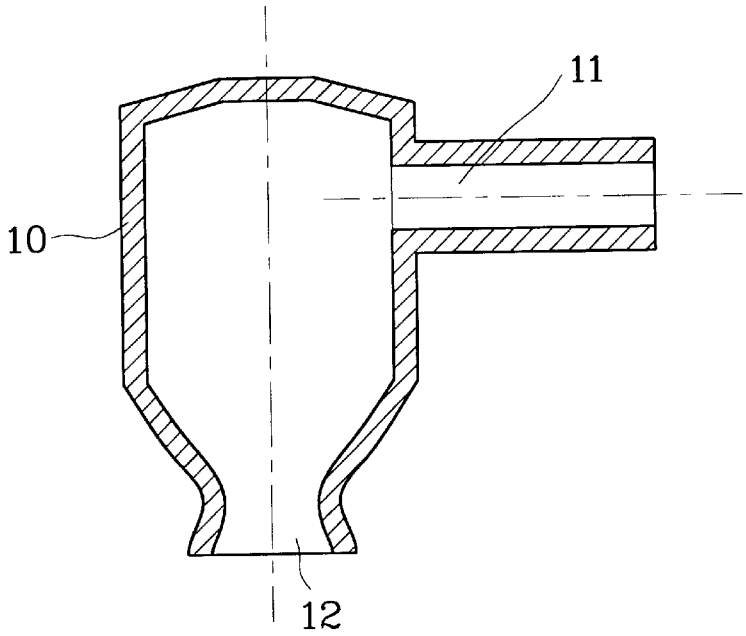
FIG. 4 (PRIOR ART)
FIG. 4 is a sectional view of a conventional hollow-core nozzle.
Figure 5:
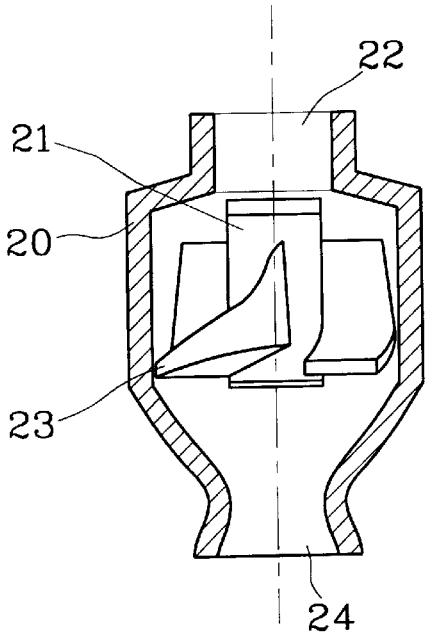
FIG. 5 (PRIOR ART)
FIG. 5 is a sectional view of a conventional solid-core nozzle.

The hollow-core nozzle 30 according to the present invention has a hollow core with a tangential horizontal type of eccentric water inlet 31. The outer rim of the water outlet 32 of the nozzle 30 has a larger stream-guide plate 33. The surface of the stream-guide plate 33 is furnished with a plurality of rows of water baffles 34, 35, and 36. The water-baffling surface of each water baffles is set approximately at a right angle to the water-spraying direction so as to have the water drops 40 hit the water baffles 34, 35, and 36 to rebound into tiny particles. Then, when the tiny drops scatter and drip downwards, the beam of such tiny drops (i.e., exits) like a solid-core beam evenly dropping down from the nozzle.

The aforesaid water baffles 34, 35 and 36 are arranged on the stream-guide plate 33 into three rows (in different radii from the center of the plate 33). The water baffles 34 in the first row are scattered around the water outlet 32 to break the water drops 40 so as to cause the water drops scattered and fallen down along the center of the water beam, i.e., to cause the water beam to be formed into a solid-core shape.

The water baffles 35 in the second row are furnished around the outer wide of the water baffles 34 in the first row at a suitable distance, but are arranged between every two water baffles 34 respectively so as to break the water drops 40 which are not broken by the water baffles 34 in the first row, and to have the water drops broken and fallen down. The tail end of each of the water baffles 35 in the second row has a bevel surface 37, of which the inner end is lower than the outer end thereof so as to have the water drops 40 hit the bevel surface 3 7 to scatter outwards further; then, the water beam formed with the water baffles 35 in the second row will scatter widely.

The outer rim of the stream-guide plate 33 on the water outlet 32 is furnished with a plurality of water baffles 36 in the outer row, being arranged in space relatively between the water baffles 34 and 35; the prime object of the water baffles 36 is to baffle the water drops 40 which are not hit with the water baffles 34 and 35. Each of water baffles 36 in the outer row has a triangle point, which would not baffle all the water drops, e.g., to have a part of the water drops passed and hit. The water drops hit by the triangle-shaped baffle will scatter to two sides so as to have the outer circle of the water beam become more even.

The present invention belong to the type of hollow-core nozzles, thus the operation pressure will not be very high, i.e., it is the same as that of the conventional tangential type of hollow-core nozzle 10. Furthermore, the present invention will not have the drawback of blocking problems. The water beam sprayed out is a solid water beam, which is the same as that from the conventional solid-core nozzle 20. The water drops sprayed out from the present inventions are smaller than that of the conventional hollow-core nozzle because of the water drops are impacted by the three rows of water baffles 34, 35 and 36.

Summing up the aforesaid description, the hollow-core nozzle of the present invention has the advantages of the conventional solid-core nozzle and the hollow-core nozzle, but without drawbacks of the aforesaid two nozzles, and therefore it is deemed an improved design. Accordingly, the appended claims are intended to cover all embodiments which do not depart from the spirit and scope of the invention.

What is claimed is:

1. A hollow-core nozzle for spraying water having a hollow passage which is in communication with a water inlet connected sideways to said hollow passage, said nozzle further comprising:

a water outlet at an end of the hollow passage;

a bell-shaped stream-guide plate furnished on an outer rim of said water outlet, said stream-guide plate being provided with, in the order away from said outer rim, a plurality of first, second, and third water baffles respectively arranged in a circular manner;

wherein said first water baffles are rectangular in shape, said second water baffles are also rectangular shape but with a bevel on one thereof facing inward, and said third water baffles are triangular in shape, so as to cause a portion of sprayed water to be broken into tiny drops which exit said stream-guide plate along a central line and an outer rim of a water beam to form a solid water beam.

* * * * *